US012298114B2

(12) United States Patent
Campbell, Jr.

(10) Patent No.: US 12,298,114 B2
(45) Date of Patent: May 13, 2025

(54) AIR DISC TARGET

(71) Applicant: Broken Arrow Marketing, Inc., Fork Union, VA (US)

(72) Inventor: Donald T. Campbell, Jr., Fork Union, VA (US)

(73) Assignee: BROKEN ARROW MARKETING, INC., Fork Union, VA (US)

( * ) Notice: Subject to any disclaimer, the term of this patent is extended or adjusted under 35 U.S.C. 154(b) by 0 days.

(21) Appl. No.: 18/628,044

(22) Filed: Apr. 5, 2024

(65) Prior Publication Data

US 2025/0060200 A1 Feb. 20, 2025

Related U.S. Application Data

(60) Provisional application No. 63/519,467, filed on Aug. 14, 2023.

(51) Int. Cl.

| | |
|---|---|
| ***F41J 9/08*** | (2006.01) |
| ***A63H 33/18*** | (2006.01) |
| ***F41J 3/00*** | (2006.01) |

(52) U.S. Cl.

CPC ..... *F41J 9/08* (2013.01); *A63H 33/18* (2013.01); *F41J 3/0004* (2013.01)

(58) Field of Classification Search

CPC ..... F41J 3/0004; F41J 9/08; F41J 1/01; A63H 33/18

USPC ..... 446/46; 273/348, 362, 364, 365

See application file for complete search history.

(56) References Cited

U.S. PATENT DOCUMENTS

| | | | | | |
|---|---|---|---|---|---|
| 248,362 | A | * | 10/1881 | Spangler | F41J 9/16 273/365 |
| 3,026,110 | A | * | 3/1962 | Hess | A63B 65/10 473/588 |
| 3,185,480 | A | | 5/1965 | Weyman | |
| 3,359,000 | A | * | 12/1967 | Schreiber | F41J 3/0004 273/365 |
| 4,115,946 | A | * | 9/1978 | Vukmirovich | A63H 33/18 473/588 |
| 4,223,473 | A | * | 9/1980 | Brown | A63H 33/18 446/46 |
| 4,241,533 | A | * | 12/1980 | Newsome | A63H 33/18 D21/443 |
| 4,253,672 | A | * | 3/1981 | Milzoff | A63H 33/18 473/588 |
| 4,290,226 | A | | 9/1981 | Stauffer | |
| 5,078,637 | A | * | 1/1992 | McFarland | A63H 33/18 473/588 |

(Continued)

FOREIGN PATENT DOCUMENTS

CN 201223733 Y 4/2009

*Primary Examiner* — Joseph B Baldori

(74) *Attorney, Agent, or Firm* — Charles S. Sara; Yanjun Ma; DeWitt LLP

(57) ABSTRACT

A collapsible, packable, and throwable aerial target of a disc-like shape, the aerial target comprising a circular body and an outer ring around periphery of the circular body, wherein the outer ring is in the form of a hollow tubular annulus that is divided into a plurality of sections, and each of the plurality of sections houses a plurality of pellets. The pellets are thoroughly filled in the outer ring sections to provide weight to the aerial target, but not overfilled to prevent flexibility, such that the aerial target can be folded and packed.

10 Claims, 9 Drawing Sheets

(56) References Cited

U.S. PATENT DOCUMENTS

| | | | | | |
|---|---|---|---|---|---|
| 5,092,608 | A * | 3/1992 | Snipes | A63B 67/08 | 473/588 |
| 5,261,846 | A * | 11/1993 | Hanna | A63H 33/18 | 446/46 |
| 5,316,312 | A | 5/1994 | Dudley | | |
| 5,490,806 | A * | 2/1996 | Spector | A63H 33/18 | 446/236 |
| 5,655,777 | A * | 8/1997 | Neading | A63B 65/08 | 473/594 |
| 5,776,021 | A * | 7/1998 | Rakonjac | A63H 33/18 | 473/588 |
| 6,174,214 | B1 * | 1/2001 | Cooper | A63H 33/18 | 473/588 |
| 6,390,879 | B1 * | 5/2002 | Spector | A63H 33/18 | 473/588 |
| 6,544,093 | B2 * | 4/2003 | Komuro | A63H 33/18 | 473/570 |
| 8,858,289 | B2 * | 10/2014 | Forte | A63H 33/18 | 446/242 |
| 9,278,293 | B1 * | 3/2016 | Healy | A63H 9/00 | |
| 2007/0072508 | A1 * | 3/2007 | Hsu | A63H 33/18 | 446/48 |
| 2013/0154191 | A1 | 6/2013 | Laporte et al. | | |
| 2017/0246552 | A1 * | 8/2017 | Anderson | A63H 33/22 | |

* cited by examiner

AIR DISC TARGET

FIELD OF THE INVENTION

The present disclosure is directed to a collapsible and packable aerial target. Specifically, the aerial target is of a disc-like shape. The aerial target is throwable into the air and can be used as, but not limited to, an archery target, a frisbee, or a dog toy.

BACKGROUND

Existing aerial targets have been saucer-like configurations and of relatively rigid construction. There is an unmet need in the art for an aerial target that is rigid enough to allow an object to strike it and foldable to save storage space.

SUMMARY

Disclosed herein is an aerial target of a disc-like shape, the aerial target comprising a circular body and an outer ring around periphery of the circular body, wherein the outer ring is in the form of a hollow tubular annulus that is divided into a plurality of sections, and each of the plurality of sections houses a plurality of pellets. The division of sections protects against centrifugal force shifting all the pellets to one spot. Preferably, the outer ring is divided into the plurality of sections by stitching, and the outer ring is equally divided into the plurality of sections.

The circular body and the outer ring of the aerial target are made of materials that are flexible enough to be folded but durable enough to allow blows by an object such as a blunt tipped arrow. Preferably, the circular body and the outer ring are made of fabric materials. Preferably, the circular body and the outer ring are made of a same material. In one embodiment, the circular body and the outer ring are made of canvas.

Preferably, the pellets are in spherical shape. More preferably, the pellets are poly pellets, like those used for weighted blankets or corn hole bean bags. The pellets are thoroughly filled in the plurality of sections of the outer ring but not overfilled, to allow the aerial target to be folded and packed.

The objects and advantages of the disclosure will appear more fully from the following detailed description of the preferred embodiment of the disclosure made in conjunction with the accompanying drawings.

BRIEF DESCRIPTION OF THE DRAWINGS

FIG. 6 shows a setter throwing the aerial target into the air; FIG. 7 shows an archer aims at the aerial target and fires an arrow at the aerial target; FIG. 8 shows the aerial target is hit by the arrow; and FIG. 9 shows the aerial target collapses after hit by the arrow.

DETAILED DESCRIPTION

Figure 1:
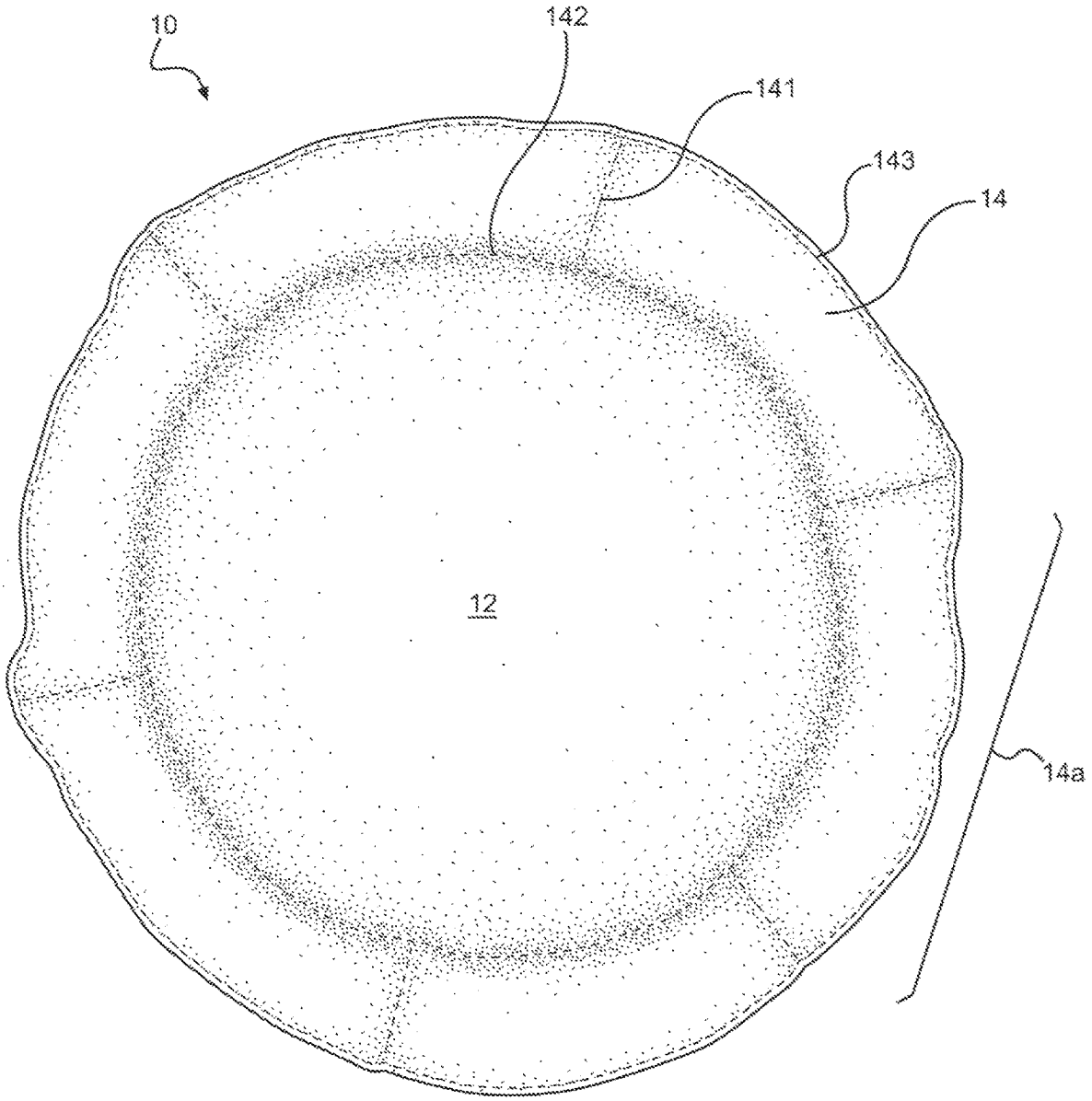
FIG. 1 is a top view of an exemplary aerial target according to the present disclosure.
Figure 2:
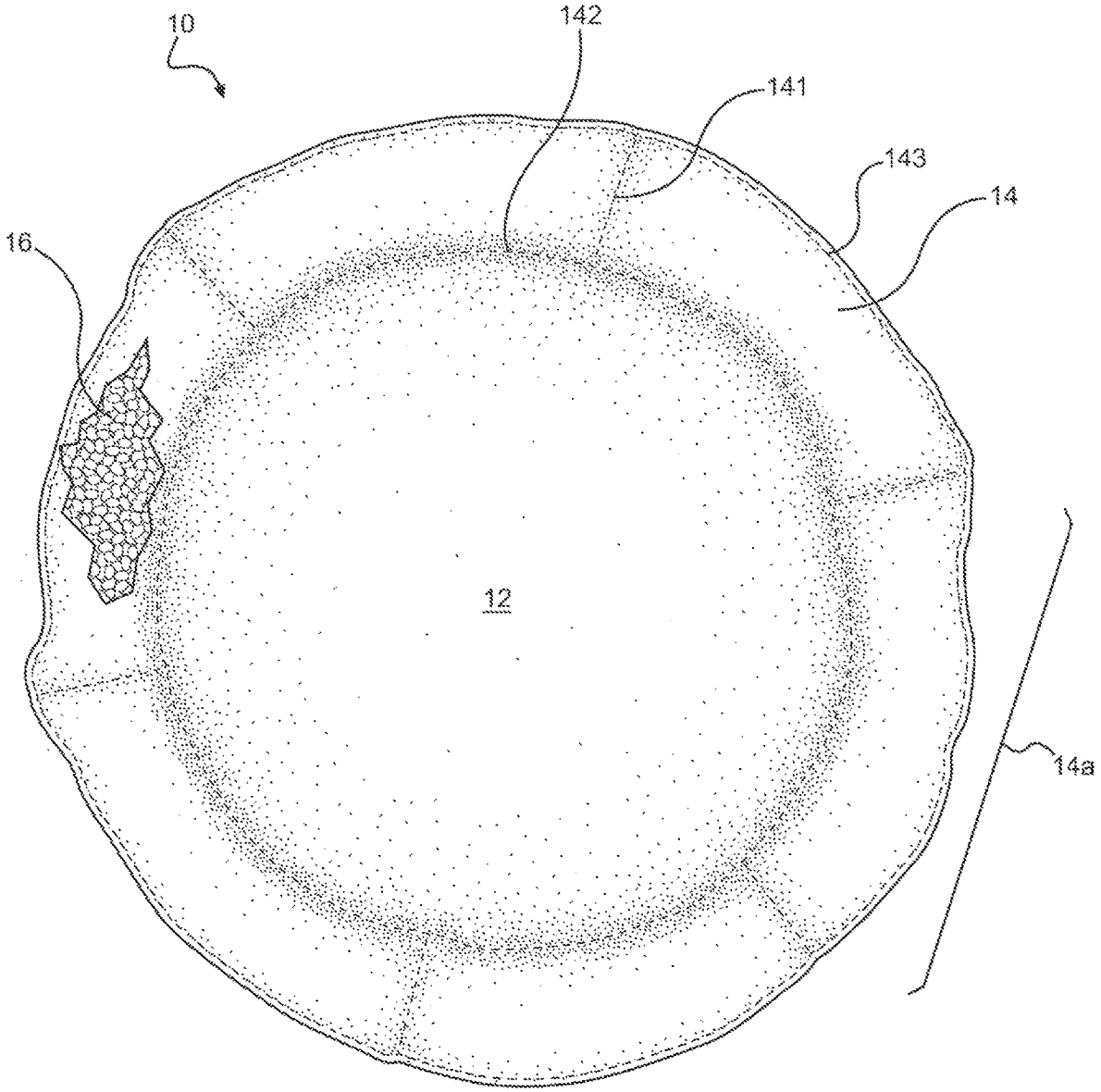
FIG. 2 is a cutaway view from top of the aerial target showing pellets inside the outer ring.
Figure 3:
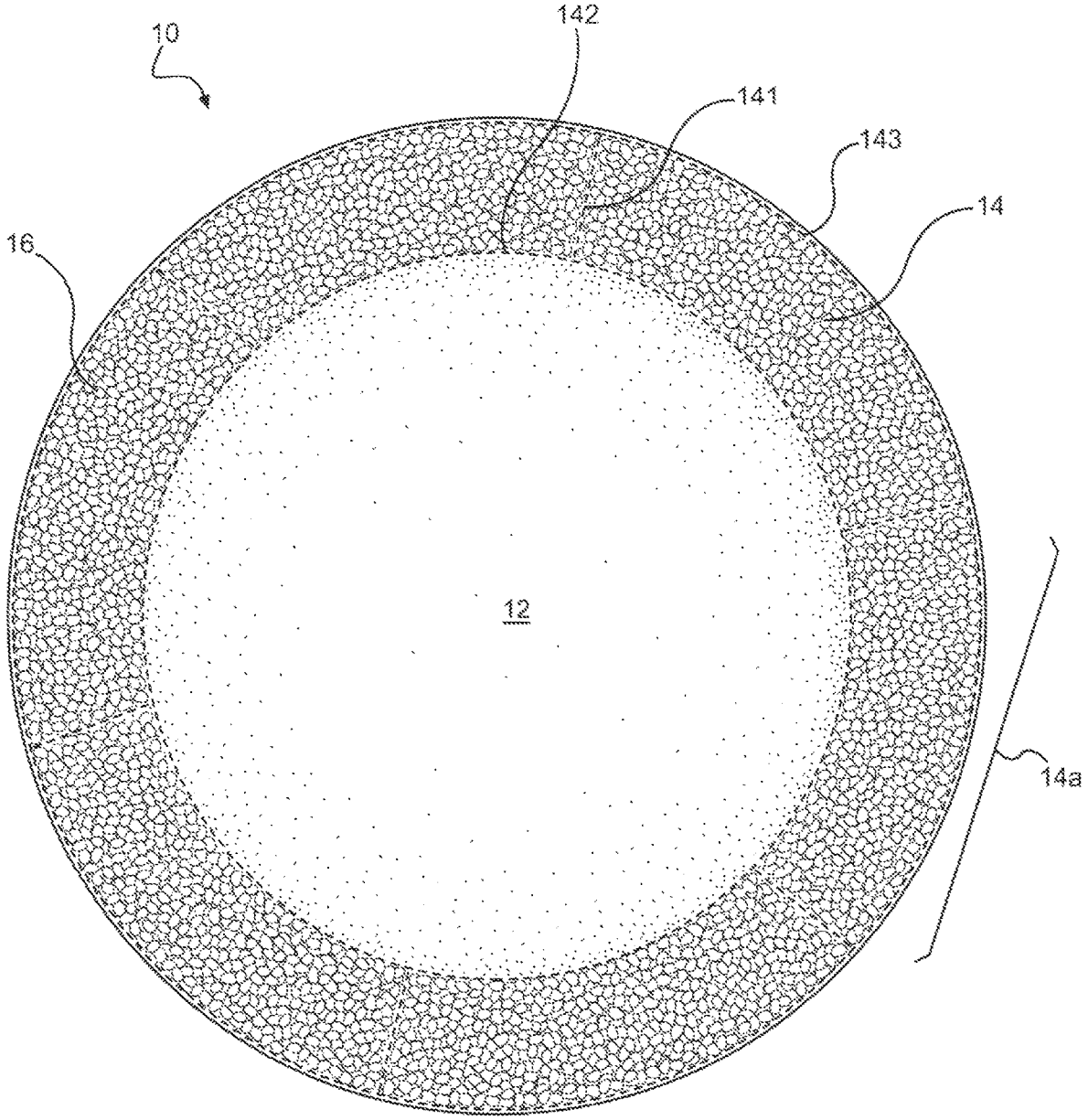
FIG. 3 is a plan view from top of the aerial target.

Disclosed herein is a collapsible, packable, and throwable aerial target that can be used for a variety of purposes, including, but not limited to, an archery target, a frisbee, and a dog toy.

Referring to FIGS. 1-9, a preferred embodiment of the present disclosure includes an aerial target 10 of a disc-like shape. As shown in FIGS. 1-4, the aerial target 10 comprises a circular body 12 and an outer ring 14 around periphery of the circular body 12. The outer ring 14 is in the form of a hollow tubular annulus which is equally divided into a plurality of sections 14*a* by the stitching 141, and each section 14*a* houses a plurality of pellets 16. The diameter of the aerial target 10 is large enough for adequately serving as a target and preferably between one foot and 3 feet. The number of the sections 14*a* that the outer ring 14 is divided is not limiting. For example, the outer ring 14 may be divided into 2, 3, 4, 5, 6, 7, 8, 9, 10, 11, 12, or more sections. In the exemplary embodiment shown in FIGS. 1-4, the outer ring 14 is divided into 6 sections.

The circular body 12 and the outer ring 14 are made of the same or different materials that are flexible enough to be folded but durable enough to allow stricken by an object such as a blunt tipped arrow. Examples of such materials include, but are not limited to, fabrics of canvas, cotton polyester, polyester, vinyl, polyethylene, nylon, carbon fiber, etc. Preferably, the circular body 12 and the outer ring 14 are made of the same material. In one embodiment, the circular body 12 and the outer ring 14 are made of durable canvas.

Figure 5:
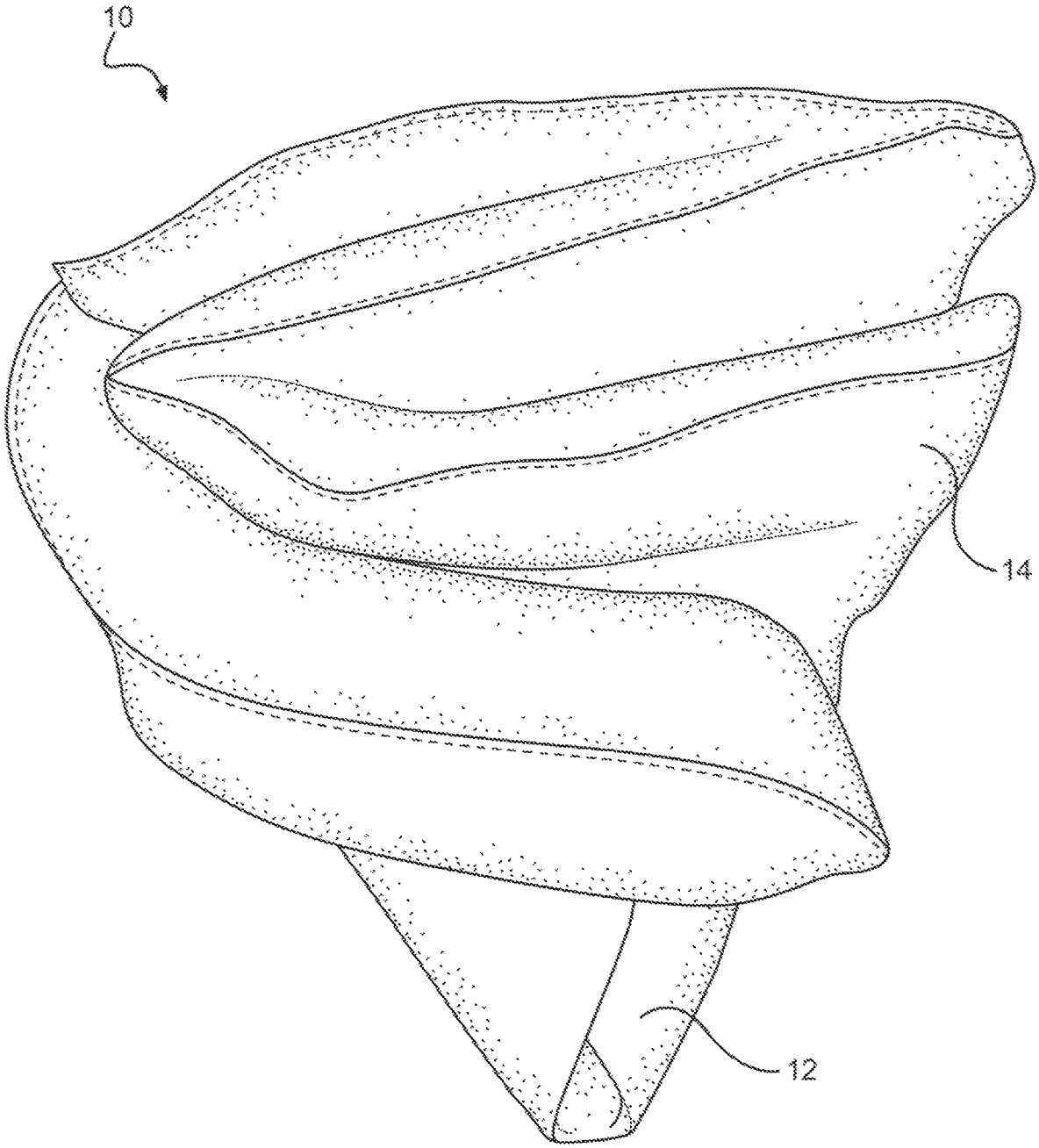
FIG. 5 shows the aerial target folded for storage.

The outer ring 14 of the aerial target 10 houses a plurality of pellets 16. The pellets 16 may be in a regular or irregular spherical, oblong, or ellipsoidal shape to allow easy movement of the pellets 16 within the outer ring. Preferably, the pellets 16 are in a spherical shape. The pellets 16 provide weight to the aerial target, and may be made of steel, copper, other metals, ceramic, marble, plastic, and the like. Examples of such pellets include, but are not limited to, metal ball bearings, poly pellets, and BB pellets, etc. In a preferred embodiment, the pellets 16 are poly pellets about an eighth of an inch in diameter, like those used for weighted blankets or corn hole bean bags. The pellets are thoroughly filled in the plurality of sections of the outer ring to provide weight to the aerial target, but not overfilled to prevent flexibility such that the aerial target can be folded and packed (FIG. 5).

The diameter of the pellets 16 is much less than the width of the outer ring 14, such that the pellets 16 are packed within the outer ring to allow the aerial target 10 to be folded and packed for storage. The diameter of the pellets 16 may be at least 2 times, at least 5 times, at least 10 times, at least 20 times, or at least 30 times smaller than the width of the outer ring 14. In preferred embodiments, the width of the outer ring 14 is between 1 and 4 inches, and the diameter of the pellets 16 is between 0.1 to 0.5 inch.

Figure 4:
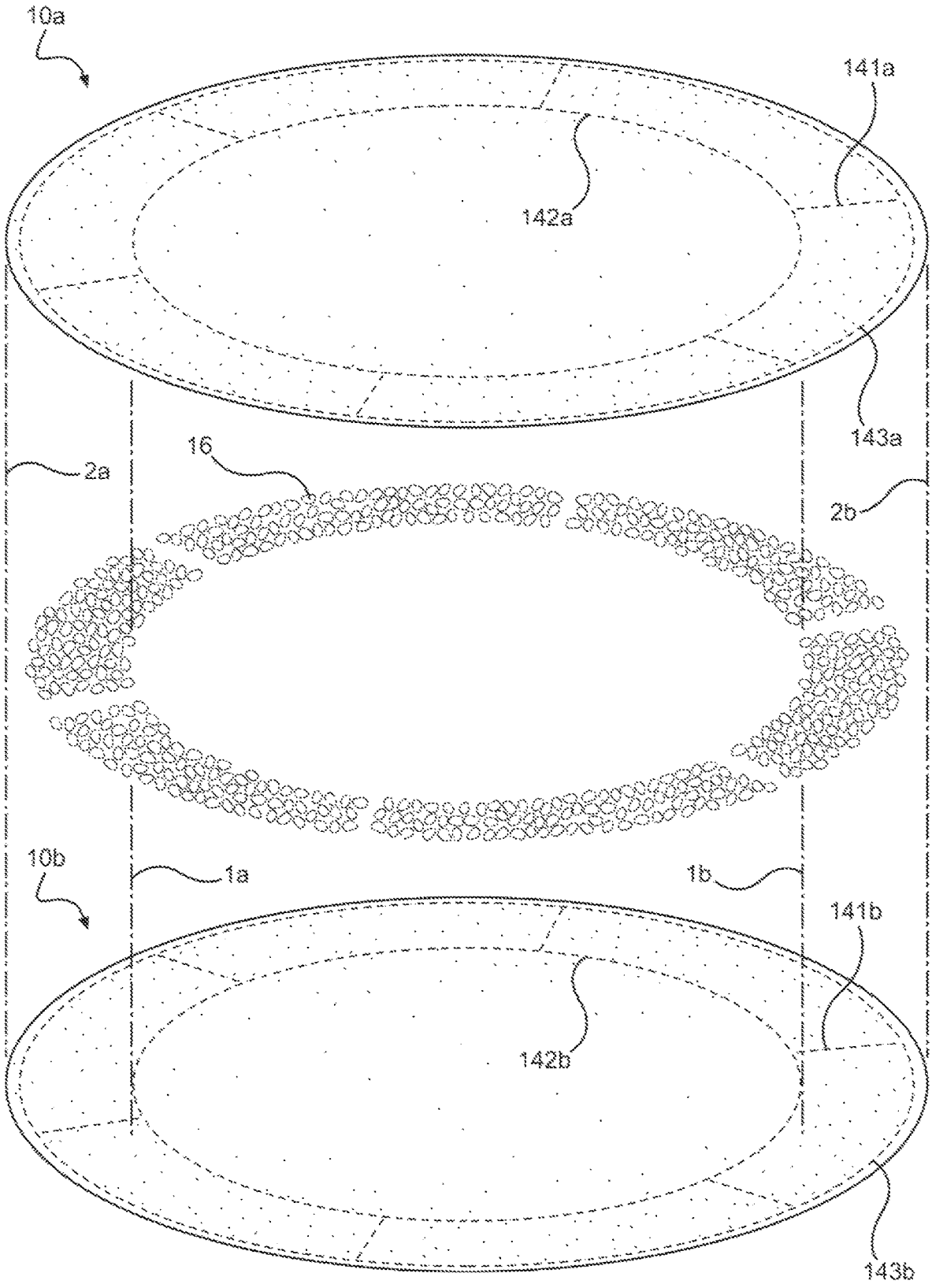
FIG. 4 is an exploded view of the aerial target.

The aerial target 10 may be made by a variety of methods. In the exemplary embodiment shown in FIGS. 1-4, the aerial target 10 is made by aligning two identical pieces of disc-like shaped fabrics 10*a* and 10*b* as indicated by lines 1*a*, 1*b*, 2*a*, and 2*b*, such that the circular stitching lines 142*a* and 143*a* on the fabric 10*a* are aligned to the circular stitching lines 142*b* and 143*b* on the fabric 10*b*, respectively (FIG. 4). The fabrics 10*a* and 10*b* are sewn together along the aligned circular stitching lines 142*a* and 142*b* to form the inner boundary 142 of the outer ring 14, and sewn together along the aligned circular stitching lines 143*a* and 143*b* to form the outer boundary 143 of the outer ring 14, wherein the pellets 16 are housed within the outer ring 14. Finally, stitchings 141 are sewn to divide the outer ring 14 into a plurality of sections (the stitching lines on fabrics 10*a* and 10*b* are shown as 141*a* and 141*b*, respectively, in FIG. 4). Alternatively, the aerial target may be made from one sheet of disc-like shaped fabric by sewing the edge of the fabric toward center to form the outer ring, and the center portion of the fabric forms the circular body. Alternatively, the aerial target may be made by attaching an outer ring divided into a plurality of sections and housing a plurality of pellets to a circular body by any methods known in the art, such as sewing, adhesion by use of an adhesive, or heat welding.

When the aerial target 10 is thrown into the air, the centrifugal motion of the spinning aerial target disperses the pellets 16 within the outer ring 14 and opens the aerial target 10 fully into a circular shape. The division of sections of the outer ring 14 protects against centrifugal force shifting all the pellets 16 to one spot.

Figure 6:
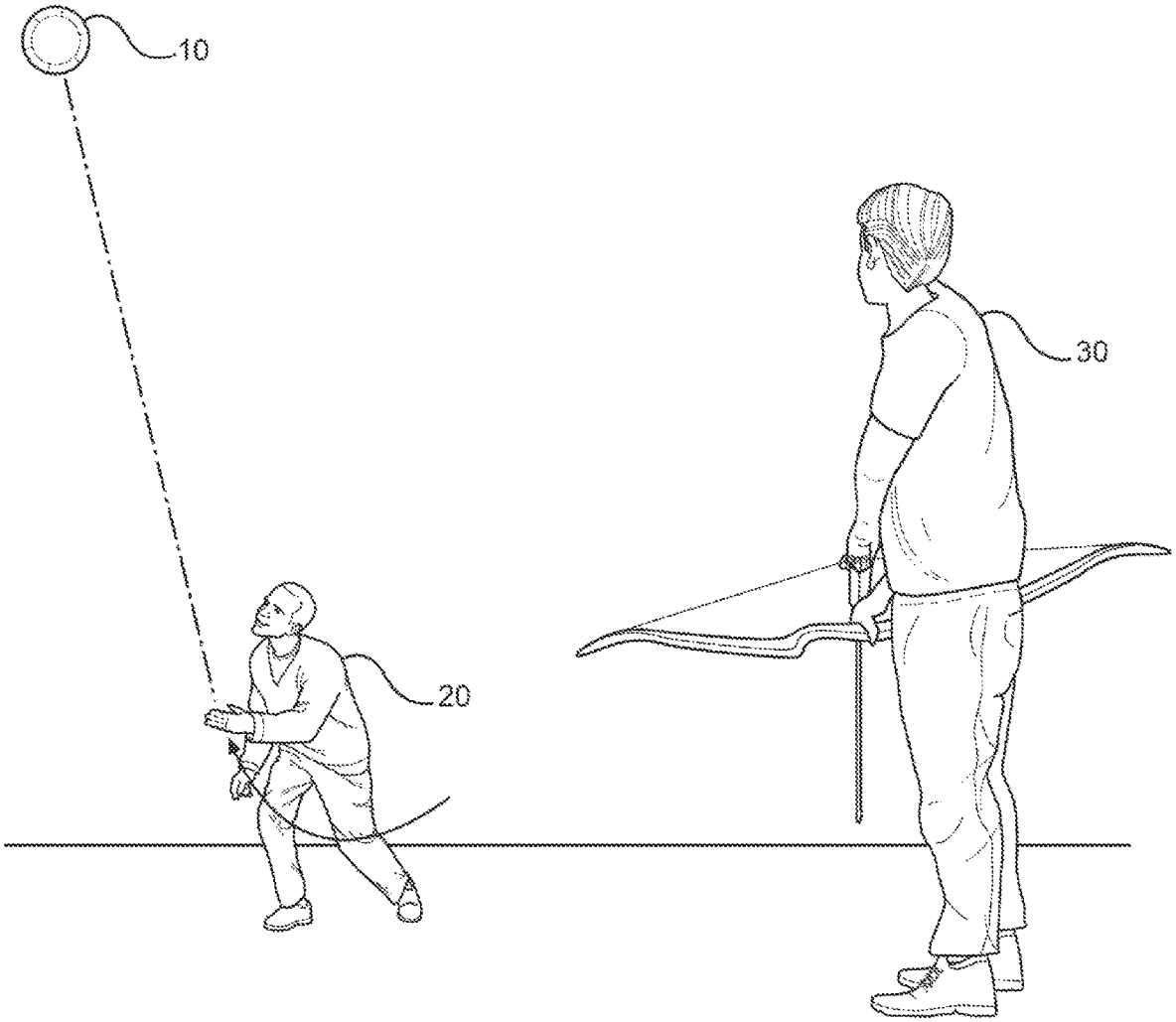
FIGS. 6-9 show an exemplary use of the aerial target as an archery target.
Figure 7:
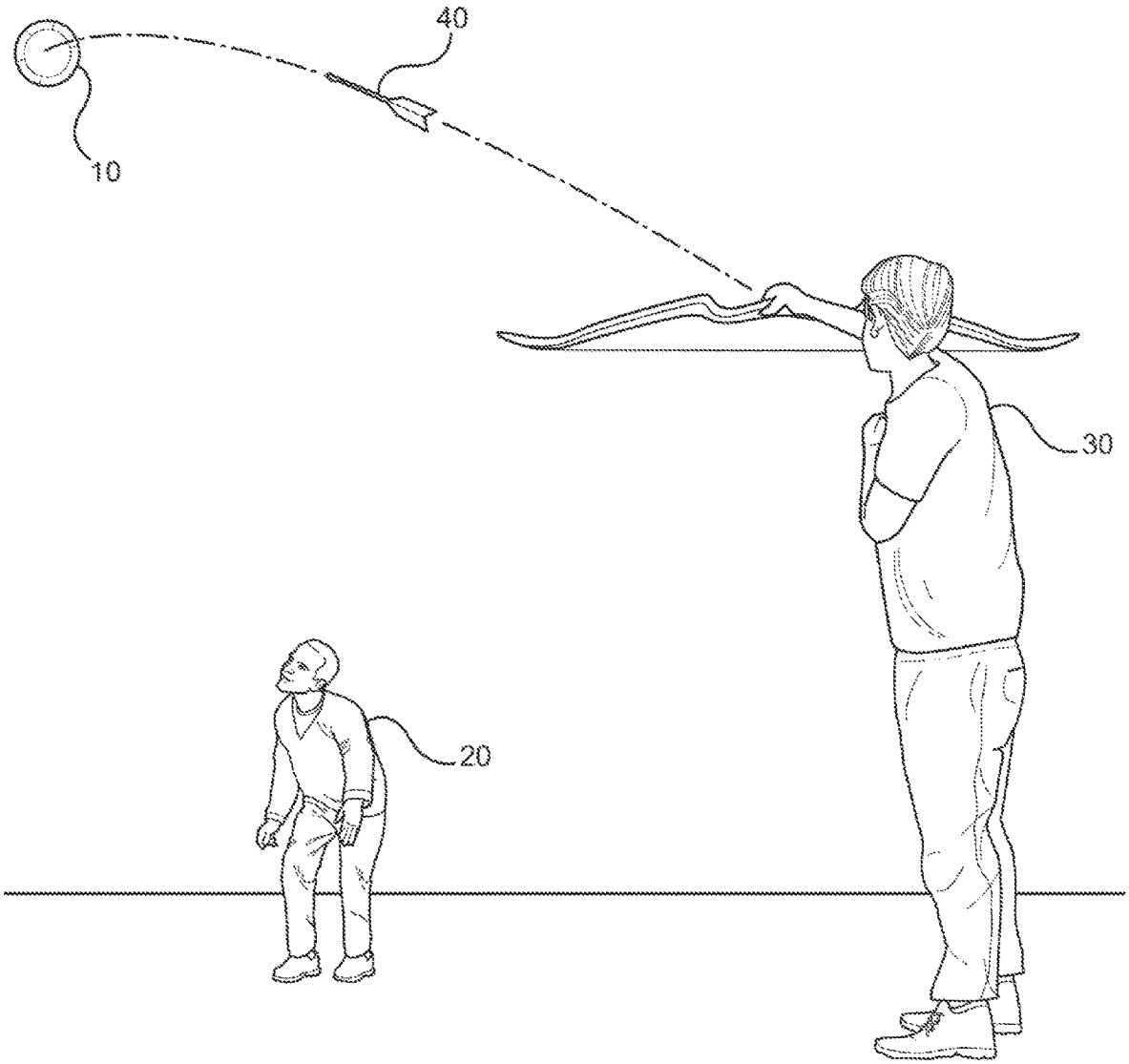
Figure 8:
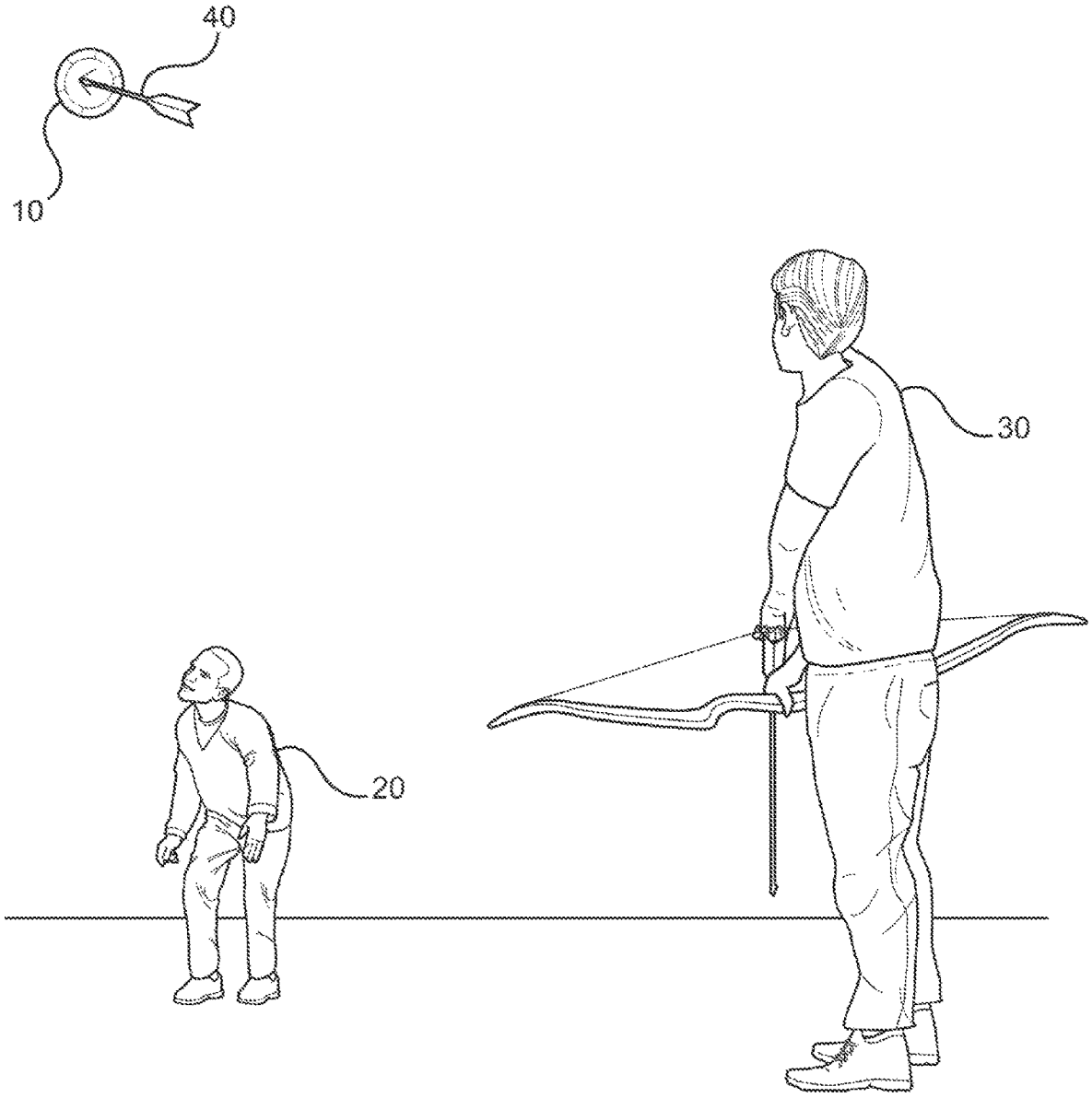
Figure 9:
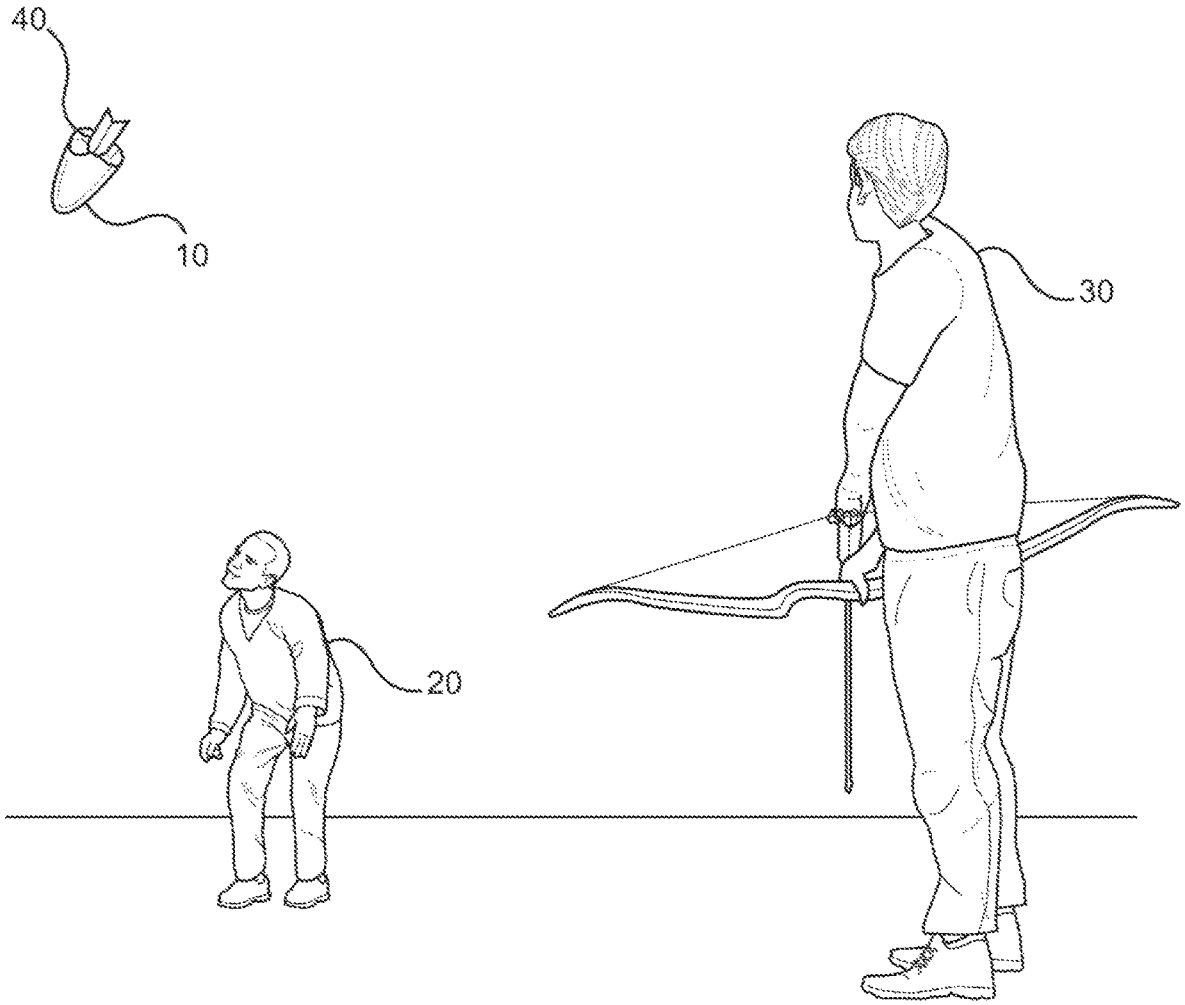

As shown in FIGS. 6-9, the aerial target 10 as described herein can be used as an archery target. A setter 20 first throws the aerial target 10 into the air, where the centrifugal motion of the spinning aerial target opens the aerial target fully into a circular shape (FIG. 6). An archer 30 aims at the aerial target 10 and fires an arrow 40 at the target (FIG. 7). The aerial target 10 is stricken by the arrow 40 (FIG. 8) and collapses to the ground (FIG. 9).

In the foregoing description, certain terms have been used for brevity, clarity, and understanding. No unnecessary limitations are to be inferred therefrom beyond the requirement of the prior art because such terms are used for descriptive purposes and are intended to be broadly construed. The different configurations and systems described herein may be used alone or in combination with other configurations and systems. It is to be expected that various equivalents, alternatives and modifications are possible within the scope of the foregoing description.

Any version of any component of the disclosure may be used with any other component of the disclosure. The elements described herein can be used in any combination whether explicitly described or not.

As used herein, the singular forms "a," "an," and "the" include plural referents unless the content clearly dictates otherwise.

As used herein, the term "or" is an inclusive "or" operator and is equivalent to the term "and/or" unless the context clearly dictates otherwise.

The systems of the present disclosure can comprise, consist of, or consist essentially of the essential elements and limitations described herein, as well as any additional or optional components, or limitations described herein or otherwise useful in the art. The disclosure provided herein suitably may be practiced in the absence of any element which is not specifically disclosed herein.

While this disclosure may be embodied in many forms, what is described in detail herein is a specific preferred embodiment of the disclosure. The present disclosure is an exemplification of the principles of the disclosure is not intended to limit the disclosure to the particular embodiments illustrated. It is to be understood that this disclosure is not limited to the particular examples, configurations, and materials disclosed herein as such configurations and materials may vary somewhat. It is also understood that the terminology used herein is used for the purpose of describing particular embodiments only and is not intended to be limiting since the scope of the present disclosure will be limited to only the appended claims and equivalents thereof.

What is claimed is:

1. An aerial target of a disc-like shape, dimensioned and configured for use as an archery target, the aerial target comprising:

a circular body that is flat, continuous, and undivided, and an outer ring around periphery of the circular body, wherein the outer ring is in the form of a hollow tubular annulus that is divided into a plurality of sections, and each of the plurality of sections houses a plurality of pellets;

wherein the circular body and outer ring are made of flexible and durable materials; and wherein the circular body and the outer ring are on the same plane when the aerial target is fully opened into the disc-like shape.

2. The aerial target of claim 1, wherein the outer ring is divided into the plurality of sections by stitching.

3. The aerial target of claim 1, wherein the outer ring is equally divided into the plurality of sections.

4. The aerial target of claim 1, wherein the circular body and the outer ring are made of fabric materials.

5. The aerial target of claim 1, wherein the fabric body and the outer ring are made of a same material.

6. The aerial target of claim 1, wherein the fabric body and the outer ring are made of canvas.

7. The aerial target of claim 1, wherein the pellets are in spherical shape.

8. The aerial target of claim 1, wherein the pellets are poly pellets.

9. The aerial target of claim 1, wherein the pellets are thoroughly filled in the plurality of sections of the outer ring but not overfilled, to allow the aerial target to be folded and packed.

10. The aerial target of claim 1, wherein the circular body and the outer ring are formed by aligning two identical pieces of disc-like shaped fabric, sewing the two pieces together along an inner set of aligned circular stitching lines to form an inner boundary of the outer ring, and sewing the two pieces together along an outer set of aligned circular stitching lines to form an outer boundary of the outer ring, wherein the center portion enclosed by the inner boundary forms the circular body.

* * * * *